US010759078B2

(12) United States Patent
Chan et al.

(10) Patent No.: US 10,759,078 B2
(45) Date of Patent: Sep. 1, 2020

(54) EG-1680 THREE HOLE ELECTRIC PUNCHER

(71) Applicant: Eagle (Shaoguan) Stationery Technology Limited, Shaoguan (CN)

(72) Inventors: Siu Leung Chan, Shaoguan (CN); Huixiong Xiong, Shaoguan (CN); Jiwu Liang, Shaoguan (CN); Xinsheng Xiao, Shaoguan (CN)

(73) Assignee: Eagle (Shaoguan) Stationery Technology Limited, Shaoguan (CN)

( * ) Notice: Subject to any disclaimer, the term of this patent is extended or adjusted under 35 U.S.C. 154(b) by 0 days.

(21) Appl. No.: 16/199,131

(22) Filed: Nov. 24, 2018

(65) Prior Publication Data

US 2020/0164540 A1 May 28, 2020

(51) Int. Cl.

| | |
|---|---|
| ***B26F 1/14*** | (2006.01) |
| ***B26D 5/16*** | (2006.01) |
| ***B26D 5/08*** | (2006.01) |

(52) U.S. Cl.

CPC ..... *B26F 1/14* (2013.01); *B26D 5/086* (2013.01); *B26D 5/16* (2013.01); *B26F 2210/02* (2013.01)

(58) Field of Classification Search

CPC .. B26F 1/14; B26D 5/08; B26D 5/086; B26D 5/14; B26D 5/16

See application file for complete search history.

(56) References Cited

U.S. PATENT DOCUMENTS

| | | | | |
|---|---|---|---|---|
| 6,076,447 | A * | 6/2000 | Damask | B26D 5/16 83/167 |
| D445,832 | S * | 7/2001 | Chan | D19/65 |
| 6,363,826 | B1 * | 4/2002 | Whiteman | B23D 35/008 83/571 |
| 6,439,093 | B1 * | 8/2002 | Davies | B26F 1/12 83/633 |
| D615,593 | S * | 5/2010 | Leung | D19/72 |
| 2002/0069742 | A1 * | 6/2002 | Whiteman | B23D 35/008 83/698.91 |
| 2003/0131700 | A1 * | 7/2003 | Balz | B26D 7/1863 83/13 |
| 2005/0132859 | A1 * | 6/2005 | Hunag | B26D 5/16 83/628 |
| 2005/0172775 | A1 * | 8/2005 | Lee | B26D 5/16 83/628 |
| 2005/0204886 | A1 * | 9/2005 | Lowenthal | B26F 1/14 83/588 |

(Continued)

*Primary Examiner* — Andrea L Wellington
*Assistant Examiner* — Richard D Crosby, Jr.

(57) ABSTRACT

Disclosed is an electric puncher. The electric puncher includes at least one punching device, a rotating shaft and a drive unit. The punching device further includes a support frame arranged on the base and a punching assembly that moves up and down along the support frame. The rotating shaft can be connected with the support frame through rotation. The rotating shaft is furnished with eccentric cams that drive the punching assembly to move up and down. The staggered arrangement of eccentric cams enables the punching assemblies to asynchronously move up and down during the rotation of rotating shaft. The drive unit drives the rotating shaft to rotate. The asynchronous vertical motion of various punching assemblies helps to save labor, thereby alleviating the requirements for motor output power and gear strength.

12 Claims, 9 Drawing Sheets

(56) References Cited

U.S. PATENT DOCUMENTS

2006/0144206 A1* 7/2006 Lee ..... B26D 7/2628 83/684
2006/0249002 A1* 11/2006 Ho ..... B26D 7/2614 83/687
2007/0056421 A1* 3/2007 Shimizu ..... B26F 1/14 83/571
2007/0131074 A1* 6/2007 Chiang ..... B26F 1/34 83/628
2007/0180969 A1* 8/2007 Kanasashi ..... B26F 1/14 83/684
2007/0221030 A1* 9/2007 Oh ..... B26D 7/015 83/684
2007/0227324 A1* 10/2007 Baba ..... G03G 15/6582 83/37
2008/0019802 A1* 1/2008 Angel ..... B26D 7/015 412/38
2008/0060567 A1* 3/2008 Aniceto ..... B26F 1/14 112/475.01
2008/0066600 A1* 3/2008 Mita ..... B26D 5/16 83/691
2008/0168877 A1* 7/2008 Chan ..... B26F 1/14 83/685
2008/0223190 A1* 9/2008 Bae ..... B26D 5/10 83/549
2010/0175523 A1* 7/2010 Leung ..... B26D 5/10 83/52
2010/0206152 A1* 8/2010 Oh ..... B26D 3/10 83/687
2010/0218753 A1* 9/2010 Whitehead ..... B26F 1/14 125/23.01
2010/0319503 A1* 12/2010 Bakker ..... B26F 1/14 83/13
2011/0113636 A1* 5/2011 Huang ..... B26F 1/14 30/357
2012/0297950 A1* 11/2012 Baba ..... B26D 5/16 83/618
2012/0297951 A1* 11/2012 Baba ..... B26D 5/16 83/618
2013/0118016 A1* 5/2013 Mazursky ..... B26B 7/00 30/123
2014/0260438 A1* 9/2014 Matsumura ..... B26F 1/02 69/2
2014/0318343 A1* 10/2014 Chang ..... B26F 1/04 83/670
2014/0345435 A1* 11/2014 Johnston ..... B21D 28/346 83/698.91
2014/0356573 A1* 12/2014 Gokkel ..... B26F 1/36 428/131
2015/0239143 A1* 8/2015 Chang ..... B26F 1/04 30/364
2015/0283723 A1* 10/2015 Yen ..... B26F 1/14 83/633
2018/0093386 A1* 4/2018 Pirayesh ..... B26F 1/02
2018/0207704 A1* 7/2018 Schussheim ..... B21D 28/28
2018/0229392 A1* 8/2018 Frenken ..... B21D 28/243
2019/0047169 A1* 2/2019 Hung ..... B26F 1/36

* cited by examiner

EG-1680 THREE HOLE ELECTRIC PUNCHER

FIELD OF INVENTION

The present invention belongs to the technical field of puncher, specifically involving electric puncher.

BACKGROUND OF INVENTION

Commonly used office punchers are normally divided into manual and electric punchers by the driving form, and could be classified by punching capacity per cycle into single-hole puncher, two-hole puncher, three-hole puncher, and multi-hole puncher; the punching capacity varies from 1 to 60 pieces of paper. Common office punchers available on market are generally operated manually, thus being time consuming, laborious and difficult to use. Hence, electric punchers is developing; however, punchers available on market with punching capacity of more than 20 sheets or multi-hole punchers consume much power and require high-strength gears, which leads to relatively high prices and low cost performance, and may frequently impair the service life of punchers, failing to address consumers' operational requirements.

CONTENT OF INVENTION

The present invention is intended to present an easy-to-use compact electric puncher with high cost performance and stable functionality so as to solve the problems raised in the background art above.

To achieve the goal described above, the present invention proposes the following technical scheme:

An electric puncher, including a base, at least two punching devices, a rotating shaft and a drive unit; the punching device includes the support frame arranged on the base and the punching assembly that moves up and down along the support frame; the rotating shaft can be connected with the support frame through rotation; the rotating shaft is furnished with eccentric cams that drive the punching assembly to move up and down; Each of the eccentric cams are arranged with certain angle relative to other cams such that the punching assemblies move up and down asynchronously during the rotation of rotating shaft; the drive unit is configured to drive the rotating shaft.

Preferably, the rotating shaft is correspondingly furnished with three eccentric cams arranged with 90° angle between each other.

Preferably, the punching assembly includes a slide frame moving up and down along the said support frame; the slide frame includes an integrally connected top board and base board; under the base board is a punch; the eccentric cams are arranged between the top board and base board of slide frame; when the flange of eccentric cam is propped against the base board, it drives the slide frame to move down along support frame, guiding the downward movement of punch to finish punching operation; when the flange of eccentric cam is propped against the top board, it drives the slide frame to move up along support frame, guiding the punch to move up and return to its home position.

Preferably, the base board of said slide frame is provided with a cushion block to increase the bearing capacity of slide frame.

Preferably, the drive unit includes a motor and a gear box; inside the gear box are carrier gear and drive gear connected through meshing transmission; the carrier gear is connected with motor transmission; the driven gear is fixed to the rotating shaft.

Preferably, the support frame includes a left support and a right support working with each other; the left support is provided with a through hole, through which the rotating shaft passes; the right support is connected to rotating shaft respectively through rotor through rotation.

Preferably, the right support is furnished with a slideway for punching assembly to move up and down; in the combined state, the eccentric cams and punching assemblies are located in the space formed by the left and right supports.

Preferably, the lower portion of the right support is provided with a punching inlet for placing papers to be punched, and the base is correspondingly provided with a groove for mounting the right support; the bottom of the said punching inlet is flush with the bench surface of base; the right support is provided with a through hole for the vertical movement of punch.

Preferably, the rotating shaft is fixedly furnished with a touch bar; the said base is provided with the first micro switch that works with touch bar.

Preferably, an upper cover is included; the upper cover is designed with a punch key with spring; the base is provided with the second micro switch that works with punch key.

Preferably, the rotating shaft is a solid square iron shaft.

Preferably, there is also a bottom cover designed with scale.

Preferably, inside the bottom cover is a battery case.

Preferably, a PCB assembly is further included and electrically coupled to the drive unit.

Preferably, a DC socket is included.

Preferably, the electric puncher is powered by battery or AC power source.

Advantages and benefits of the present invention:

1. Compared with the prior art, the EG-1680 Three hole electric puncher drives the gear assembly and the rotating shaft to rotate through a motor so that the eccentric cam rotates in the slide frame, thereby causing the punch to move up and down along the slideway of right support for cutting paper; This product is compact in structure, easy to use, cost-effective, and stable in function.

2. In the electric puncher of the present invention there are a number of eccentric cams arranged with angular misalignments that enable the asynchronous vertical motion of punching assembly through the rotation of rotating shaft; each time the eccentric cam rotates one revolution, the punching assembly finishes a cycle of vertical reciprocating motion. The asynchronization saves labor, thereby alleviating the requirements for motor output power and gear strength.

SPECIFIC EMBODIMENTS

To facilitate the understanding by the skilled in the art, the present invention will be further described in combination with attached drawings and embodiments.

Embodiment 1

Figure 1:
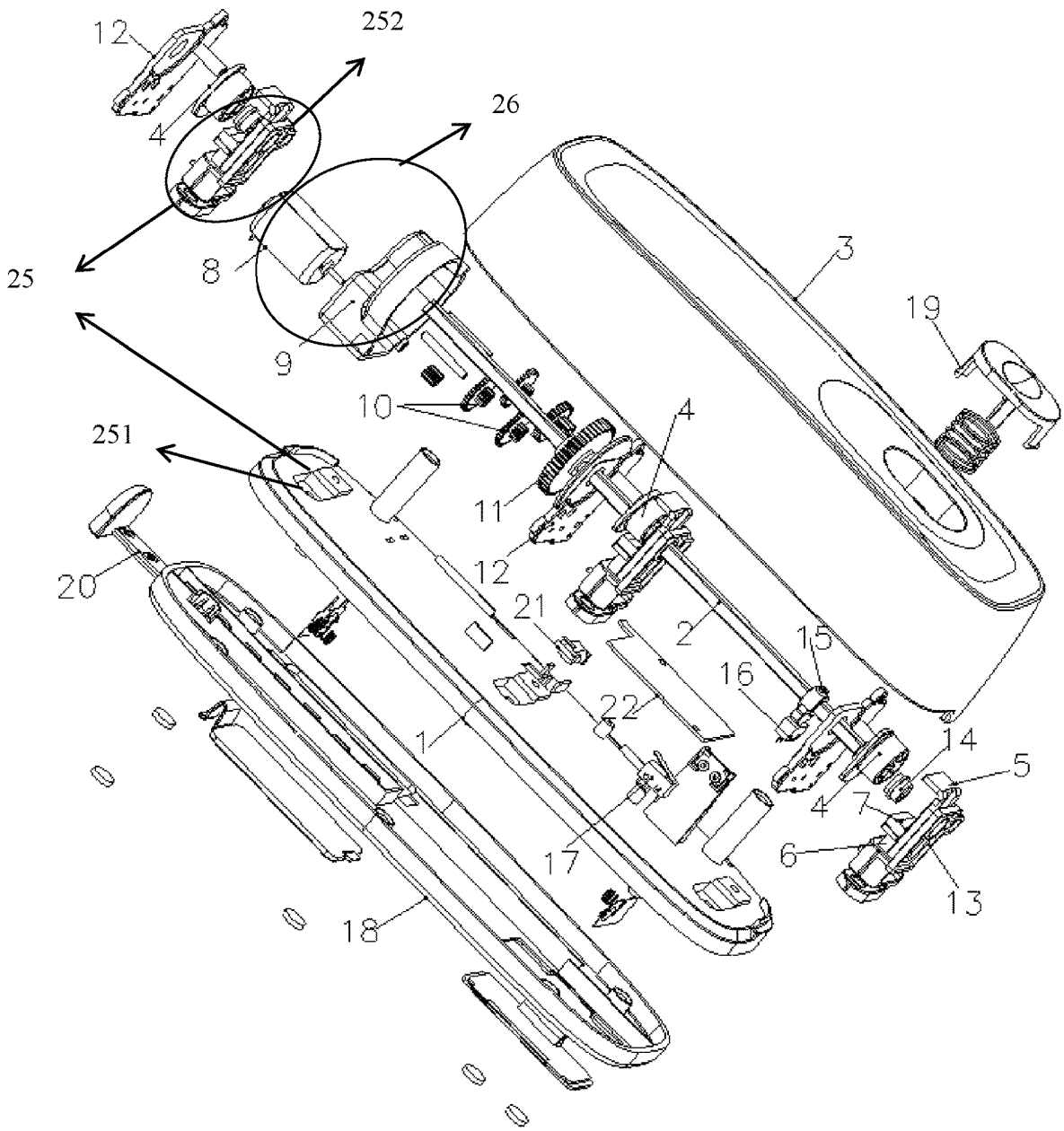
FIG. 1 is the exploded perspective view of electric puncher.
Figure 3:
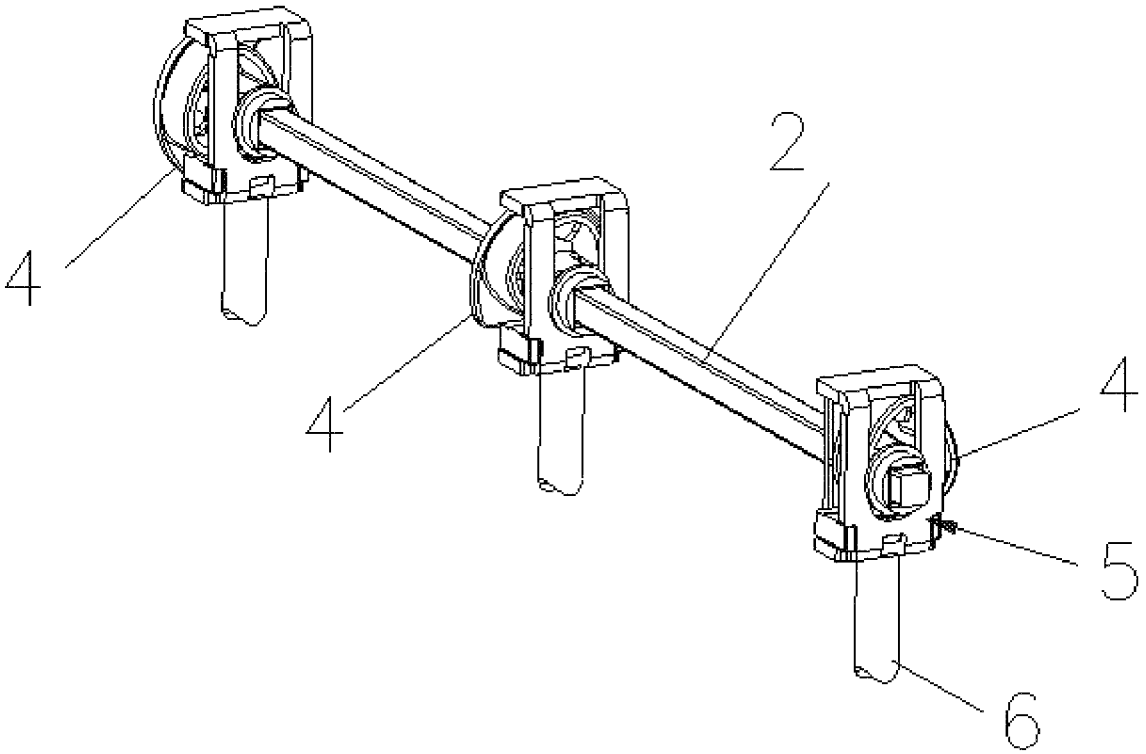
FIG. 3 is the schematic view indicating the assembly of punching device, eccentric cam and rotating shaft.
Figure 7:
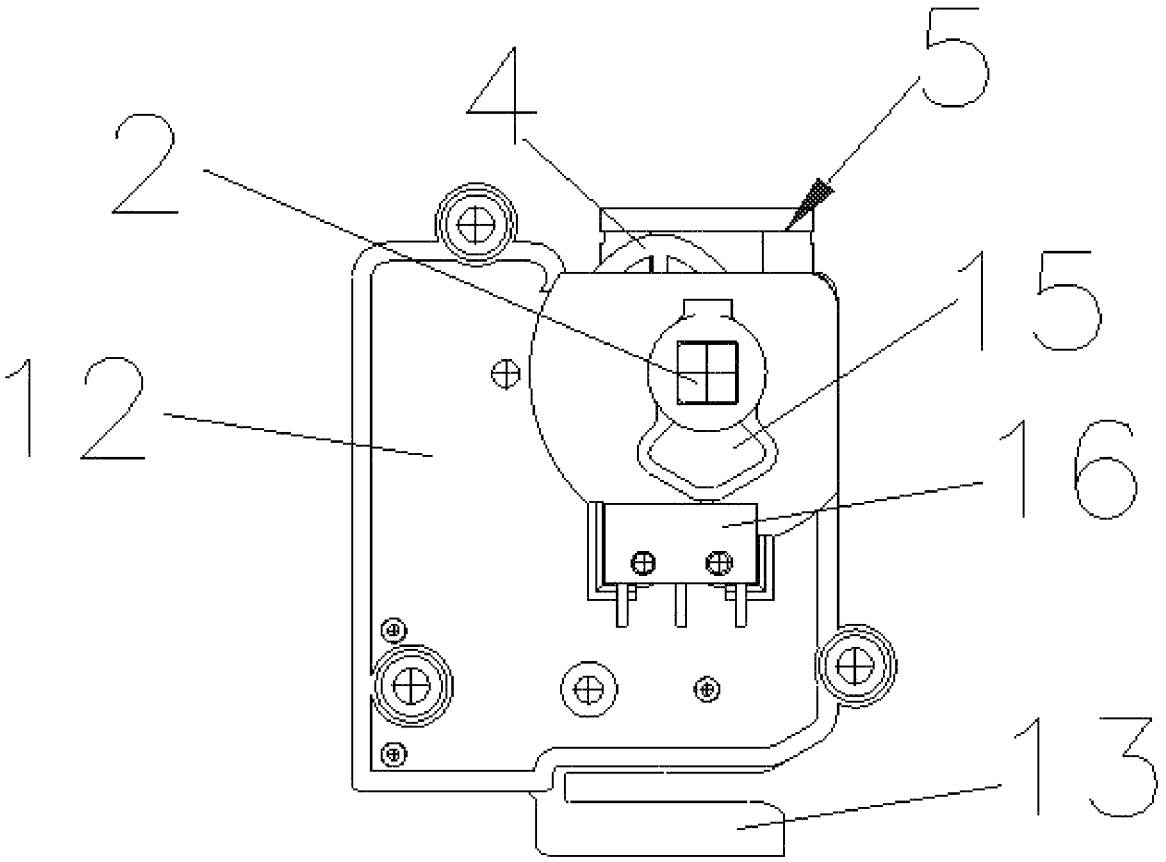
FIG. 7 is the schematic illustration of touch bar and the first micro switch.

Referring to FIGS. 1, 3 and 7, the electric puncher includes a base 1, a punching device 25, a rotating shaft 2 and a drive unit 26; the punching device 25 includes the support frame 251 arranged on the base 1 and the punching assembly 252 that moves up and down along the support frame 251, of which the number being two in this embodiment; the rotating shaft 2 is a solid square iron shaft that can be connected with the support frame 251 during a rotation of the rotating shaft 2; the rotating shaft 2 is correspondingly furnished with appropriate eccentric cams 4 that drive the punching assembly 251 to move up and down; the eccentric cams 4 are arranged with an angle of 90° between one another so that the punching assemblies 251 move up and down asynchronously during the rotation of rotating shaft 2; rotating shaft 2 is also fixedly designed with a touch bar 15; the base 1 is furnished with the first micro switch 16 cooperating with touch bar 15; the drive unit is configured to drive the rotating shaft 2.

Compared with prior art, the electric puncher EG-1680 of the present invention is designed with a number of eccentric cams 4 arranged with angular misalignments that enable the asynchronous vertical motion of punching assembly through the rotation of rotating shaft 2; each time the eccentric cam 4 rotates one revolution, the punching assembly finishes a cycle of vertical reciprocating motion. The asynchronization saves labor, thereby alleviating the requirements for motor output power and gear strength. This product is compact, easy to sue, cost effective, and stable in function.

Figure 2:
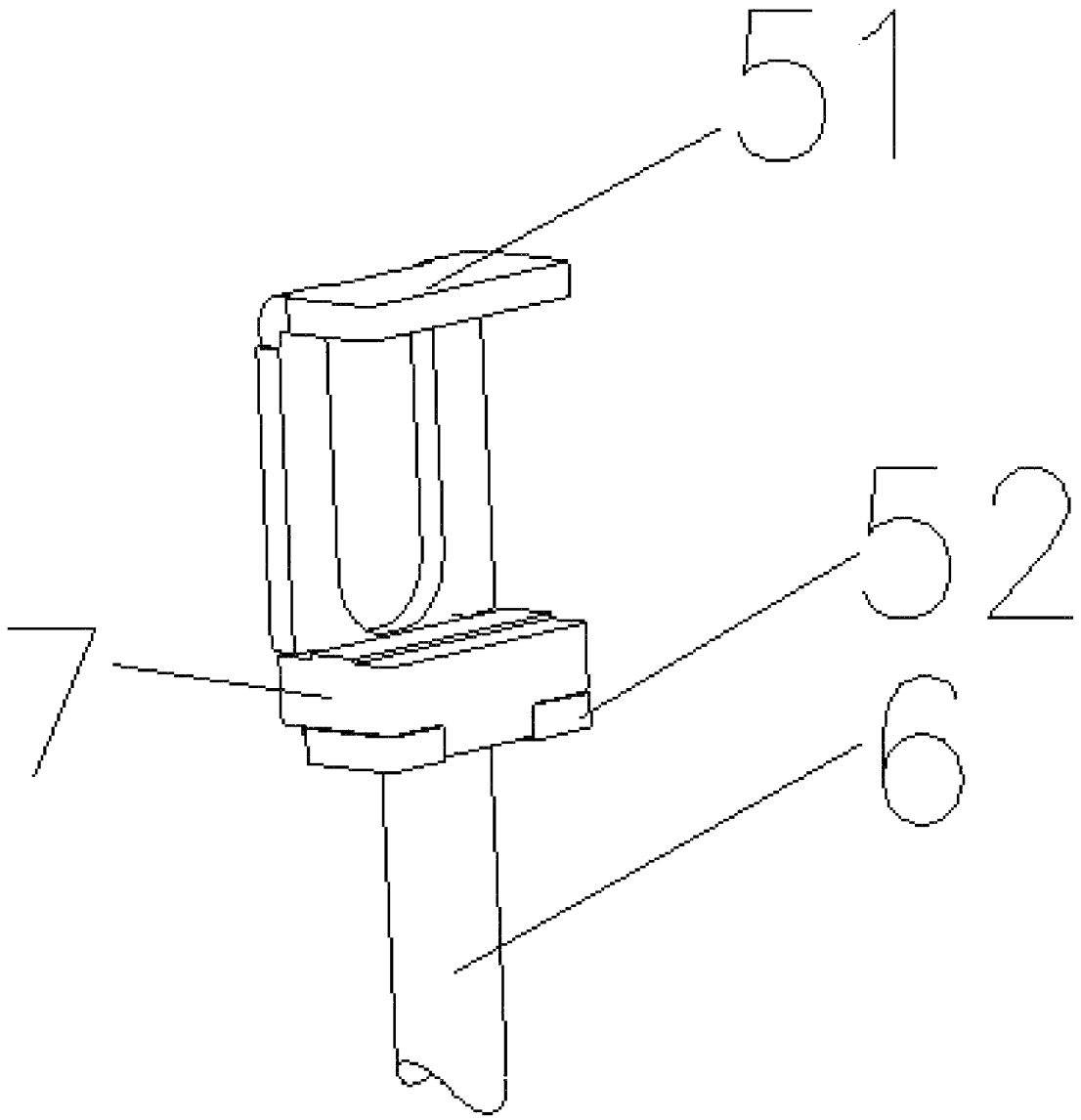
FIG. 2 is the schematic structural view of punching assembly.
Figure 5:
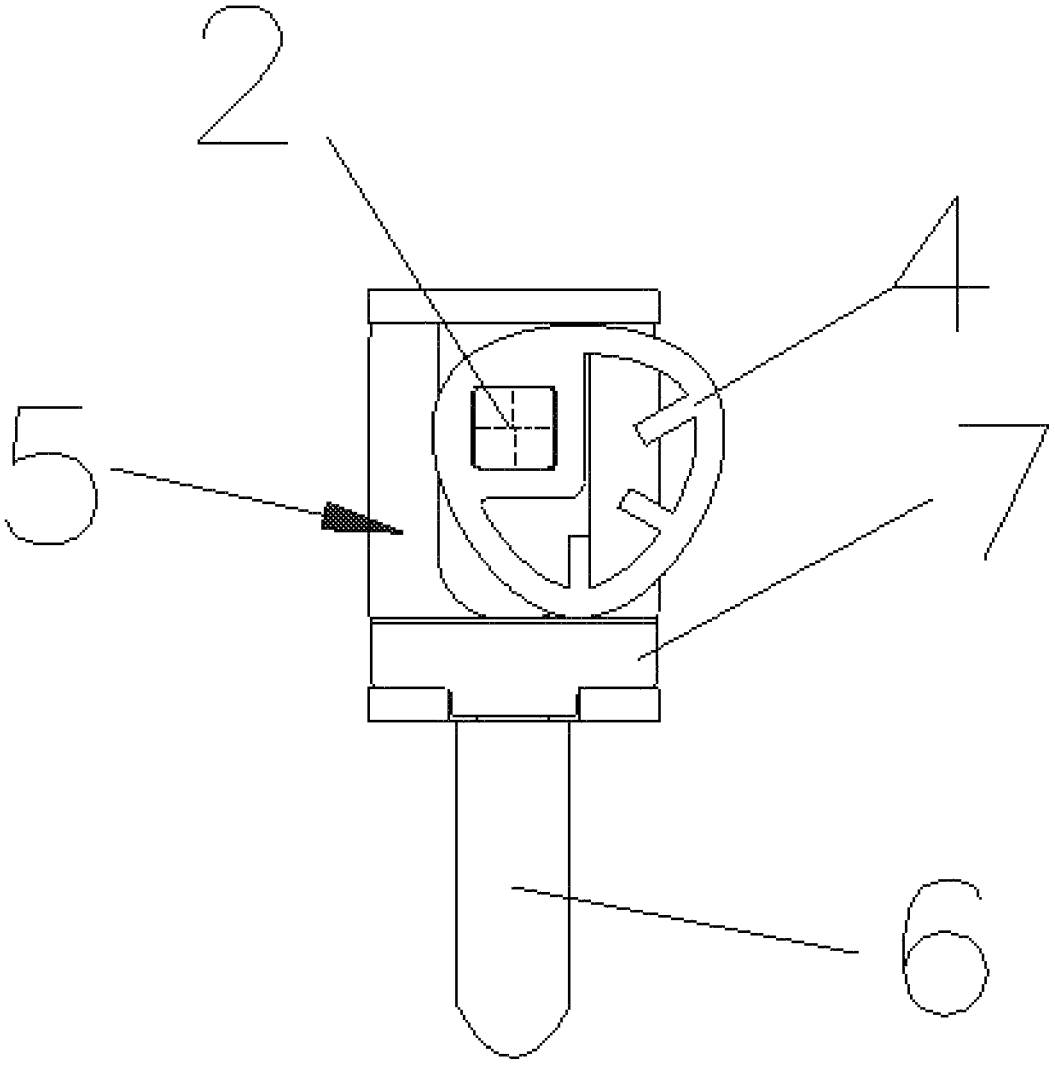
FIG. 5 is the schematic illustration of punching assembly with the eccentric cam rotated by 180°.
Figure 6:
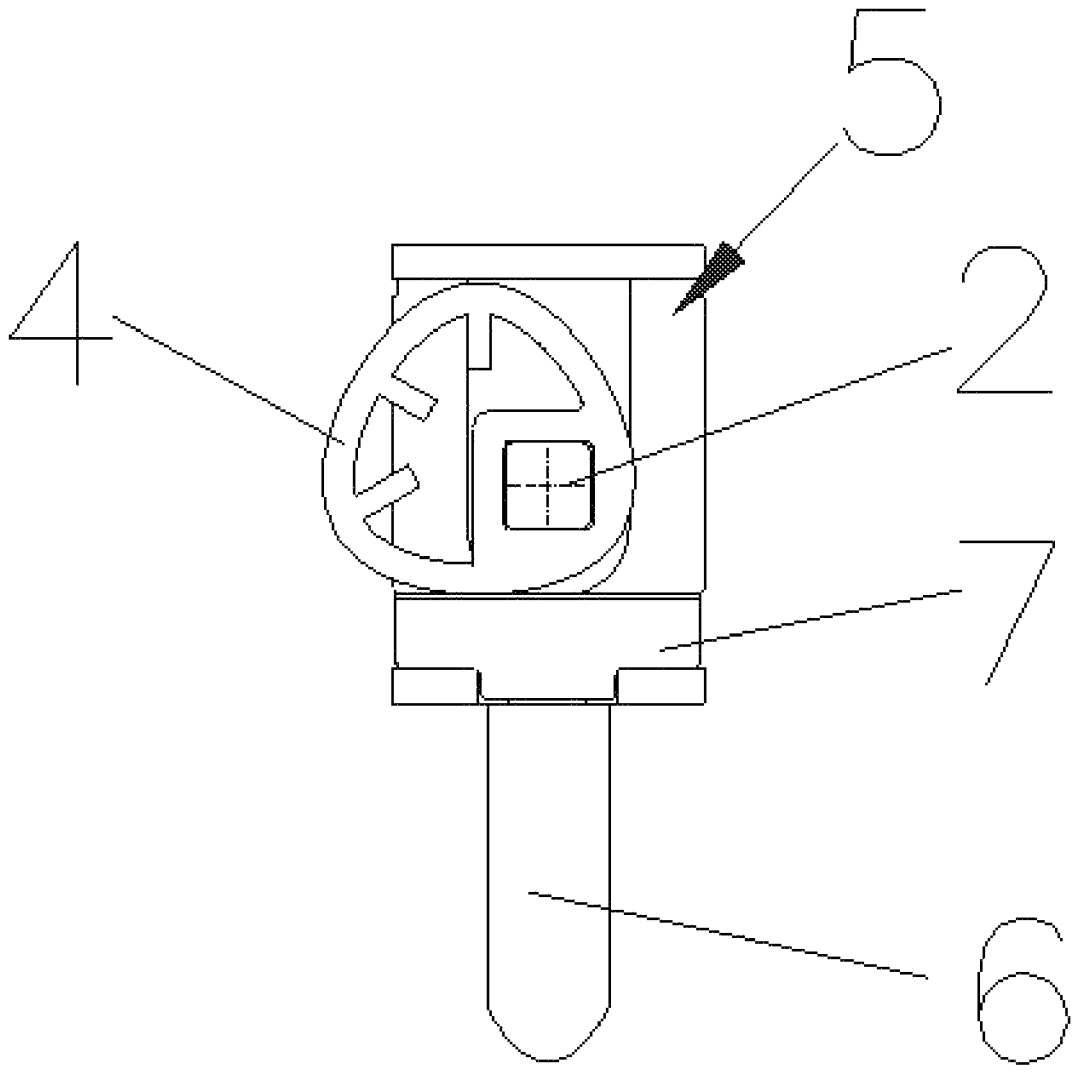
FIG. 6 is the schematic illustration of punching assembly with the eccentric cam rotated by 360°.

As shown in FIGS. 2, 5 and 6, the said punching assembly includes a slide frame 5 moving up and down along the said support frame; the said slide frame 5 includes the integrally connected top board 51 and base board 52; under the said base board 52 is a punch 6; the said eccentric cams 4 are arranged between the top board 51 and base board 52 of slide frame 5; when the flange of eccentric cam 4 is propped against the base board 52, it drives the slide frame 5 to move down along support frame, guiding the downward movement of punch 6 to finish punching operation; when the flange of eccentric cam 4 is propped against the top board 51, it drives the slide frame 5 to move up along support frame, guiding the punch 6 to move up and return to its home position. The base board 52 of slide frame 5 is designed with a cushion block 7 to increase the bearing capacity of slide frame 5.

Figure 8:
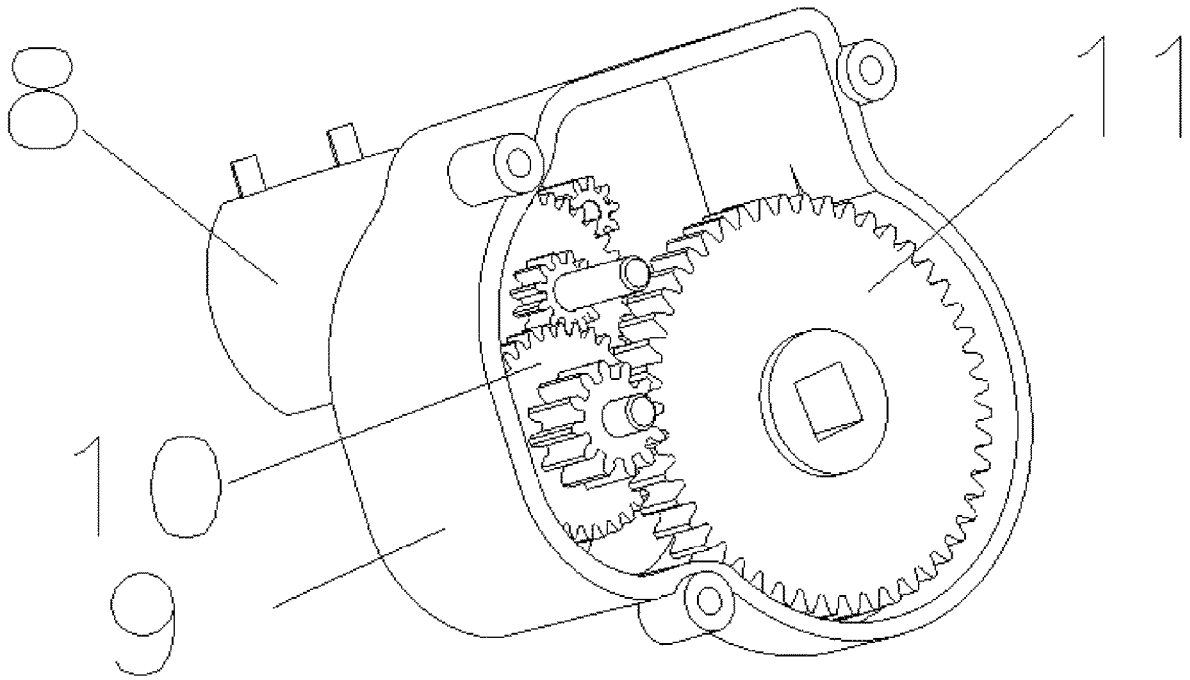
FIG. 8 is the schematic structural view of drive unit.

As shown in FIG. 8, the said drive unit includes a motor 8 and a gear box 9; inside the said gear box are carrier gear 10 and drive gear 11 connected through meshing transmission; the said carrier gear 10 is connected with motor 8 transmission; the said driven gear 9 is fixed to the rotating shaft 2.

Specifically, the said support frame includes a left support 12 and a right support 13 working with each other; the said left support 12 is provided with a through hole, through which the rotating shaft passes; the said right support 13 is connected to rotating shaft 2 respectively through rotor 14 through rotation.

Figure 4:
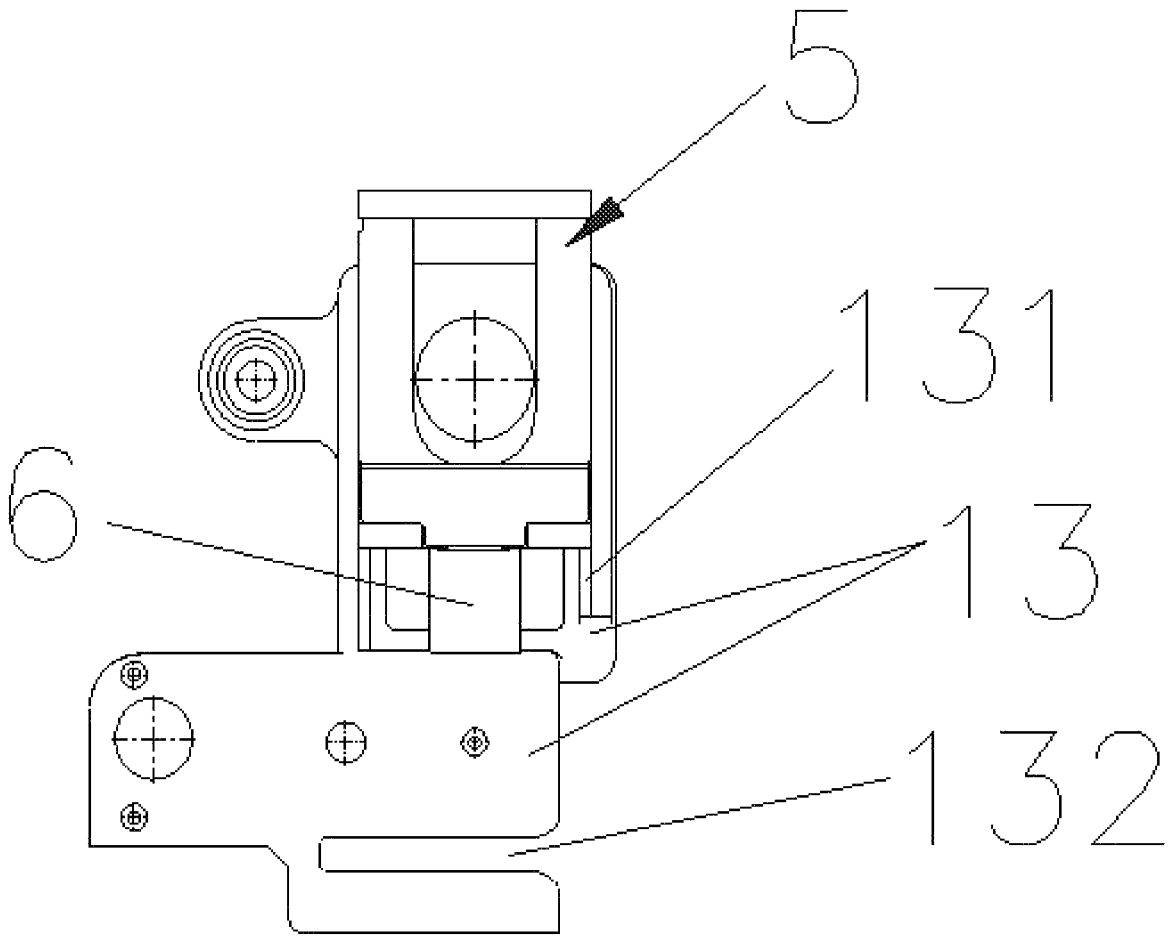
FIG. 4 is the schematic view indicating the assembly of punching assembly and right support.

Specifically as shown in FIG. 4, the said right support 13 is furnished with a slideway 131 for punching assembly to move up and down; in the combined state, the said eccentric cams 4 and punching assemblies are located in the space formed by the left 12 and right supports 13 to assure compact structure and the stable function during operation.

Specifically as shown in FIG. 4, the lower portion of the right support 13 is provided with a punching inlet 132 for placing paper, and the base 1 is correspondingly designed with a groove 14 for mounting the right support; in the combined state, the bottom of the said punching inlet 132 is flush with the bench surface of base 1; the said right support 13 is designed with a through hole for the vertical movement of punch.

This electric puncher further includes upper cover 3 and bottom cover 18; upper cover 3 is designed with a spring-loaded punch key 19; base 1 is furnished with the second micro switch 17 that works with punch key 19; the said bottom cover 18 is provided with scale 20 that works with punching inlet 132 to limit the location of paper; inside the bottom cover is a battery case for accommodating the batteries.

Figure 9:
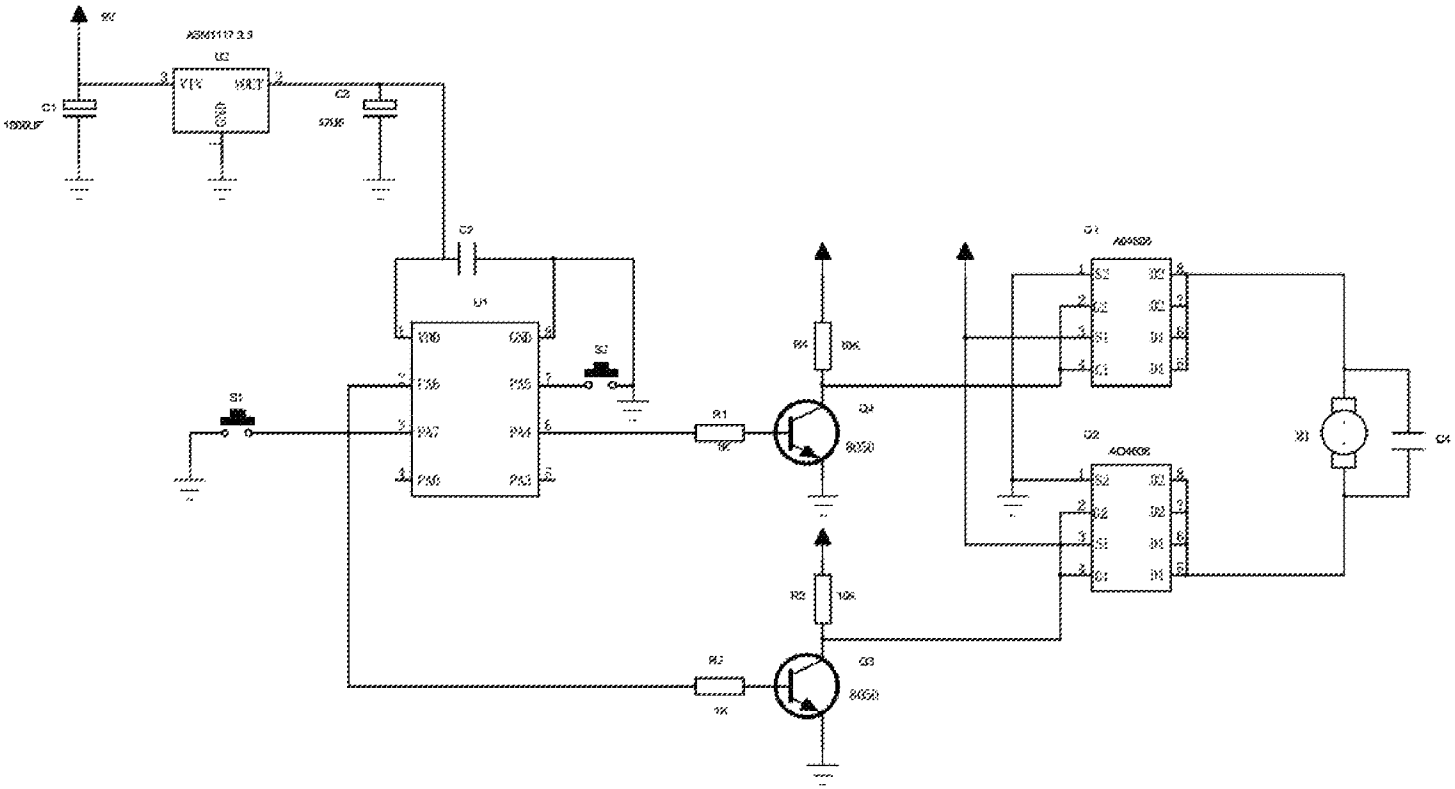
FIG. 9 is the schematic circuit diagram of the electric puncher of the present invention.

The electric puncher further includes PCB (Printed Circuit Board hereinafter referred to as PCB) assembly 22; the said PCB assembly 22 is electrically connected with drive unit, and the schematic circuit diagram in PCB assembly is shown in FIG. 9; to avoid motor underpower resulting from excessively low voltage of (old) battery, which may cause the punch to fail to penetrate (a number of pieces of) paper, the PCB is specially designed with a reverse feature; operating principle of the PCB assembly: The motor runs forward when S1 is closed. When the motor runs forward to a certain position, S2 is closed, which causes the motor to stop; if S2 is not closed within 4 seconds after the forward operation of motor after the closing of S1, the motor will run reversely until S2 is closed and the motor stops. If S is still not closed within 4 seconds after the reverse operation of motor, the motor will stop.

The electric puncher further includes DC socket 21; the electric puncher of the present invention can be powered by battery or AC power source.

Operating principle of the electric puncher of the present invention: Put the paper at punching inlet 132; turn on the power supply; press punch key 19 and touch the second micro switch 17, when the motor 8 is started to drive the gear set, rotating shaft 2 and eccentric cam 4 to rotate; eccentric cam 4 pushes cushion block 7 to move down together with punching assembly along the slideway 131 of right support for paper cutting; as shown in FIG. 5, when the rotation angle of eccentric cam 4 reaches 180°, which is to say, the flange of eccentric cam is propped against base board 52, the punching assembly moves down to finish the punching operation; as shown in FIG. 6, when the rotation angle of eccentric cam reaches 360°, which is to say, the flange of eccentric cam is propped against top board 51, touch bar 15 touches the first micro switch 16, when motor 8 is powered off; the punching assembly moves up to its home position, and a paper-cutting cycle is finished here.

The embodiment above only deals with the preferred mode of execution of the present invention; although its description is specific and detailed, this shall in no case restrict the scope of right to the present invention. Hence, the scope of patent protection for the present invention shall be subject to the attached claims.

What is claimed is:

1. An electric puncher, including a base, at least two punching devices, a rotating shaft and a drive unit;

each of the punching device further comprises a support frame arranged on the base, and a punching assembly that moves up and down along the support frame;

the rotating shaft is connected with the support frame during rotation; the drive unit is configured to drive the rotating shaft to rotate;

wherein each of the punching assembly is further provided with a corresponding eccentric cam on the rotating shaft for driving the punching assembly to move up and down; and each of the eccentric cam is arranged with angles relative to other cams such that the punching assemblies move up and down asynchronously during the rotation of rotating shaft.

2. The electric puncher of claim 1, wherein the number of the support frame and punching assembly being three; and the number of the eccentric cam being three and the angles between each of the eccentric cam being 90°.

3. The electric puncher of claim 1, wherein the punching assembly further includes a slide frame moving up and down along the support frame; the slide frame includes an integrally connected top board and base board; a punch is provided under the base board; each of the eccentric cam is arranged between the top board and the base board of slide frame; when a flange of the eccentric cam is propped against the base board, the eccentric cam drives the slide frame to move down along support frame, guiding a downward movement of the punch to finish a punching operation; when the flange of eccentric cam is propped against the top board, the eccentric cam drives the slide frame to move up along the support frame, guiding the punch to move up and return to an initial position.

4. The electric puncher of claim 3, wherein the base board is provided with a cushion block.

5. The electric puncher of claim 1, wherein the drive unit includes a motor and a gear box; the gear box is further provided with carrier gear and drive gear connected through meshing transmission therein; the carrier gear is connected with a motor transmission; and the driven gear is fixed to the rotating shaft.

6. The electric puncher of claim 1, wherein the support frame includes a left support and a right support working with each other; the left support is provided with a through hole, through which the rotating shaft passes; and the right support is connected to the rotating shaft during a rotation of the rotating shaft.

7. The electric puncher of claim 6, wherein the right support is provided with a slideway for the punching assembly to move up and down; and the eccentric cam and the punching assembly are located in the space formed by the left support and the right support.

8. The electric puncher of claim 6, wherein a lower portion of the right support is provided with a punching inlet for placing papers to be punched, and the base is correspondingly provided with a groove for mounting the right support; the bottom of the punching inlet is flush with a bench surface of base; the right support is provided with a through hole for a vertical movement of punch.

9. The electric puncher of claim 1, wherein a touch bar is fixedly provided on the rotating shaft and a first micro switch cooperating with the touch bad is provided on the base.

10. The electric puncher of claim 1, wherein an upper cover is arranged around the punching device, the rotating shaft and the drive unit; and a punch key with a spring is provided on the upper cover and a second micro switch cooperating with the punch key is provided on the base.

11. The electric puncher of claim 1, wherein the rotating shaft is a solid square iron shaft.

12. The electric puncher of claim 1, wherein a bottom cover is further provided at the bottom of the base; and the bottom cover is provided with a scale.

* * * * *